US006174207B1

(12) United States Patent
Cleveland

(10) Patent No.: US 6,174,207 B1
(45) Date of Patent: Jan. 16, 2001

(54) BATTERY TERMINAL CONNECTOR

(76) Inventor: Lance B. Cleveland, Rte. 1 Box 235, Davisville, WV (US) 26142

( * ) Notice: Under 35 U.S.C. 154(b), the term of this patent shall be extended for 0 days.

(21) Appl. No.: 09/426,151

(22) Filed: Oct. 22, 1999

(51) Int. Cl.[7] ..... H01R 4/50
(52) U.S. Cl. ..... 439/773; 439/770; 439/759
(58) Field of Search ..... 439/773, 759, 439/770, 772

(56) References Cited

U.S. PATENT DOCUMENTS

| | | | | |
|---|---|---|---|---|
| 1,820,429 | * | 8/1931 | Bohan | 439/773 |
| 1,943,190 | * | 4/1934 | Sands | 439/773 |
| 1,953,821 | * | 4/1934 | Rabe | 439/759 |
| 2,663,854 | * | 12/1953 | Peterson | 439/773 |
| 3,521,223 | * | 7/1970 | Martinez | 439/773 |
| 4,470,654 | * | 9/1984 | Friedman | 339/95 |
| 5,556,309 | * | 9/1996 | Sharpe et al. | 439/759 |
| 5,575,693 | * | 11/1996 | Dykas et al. | 439/773 |
| 5,588,883 | * | 12/1996 | Hattori | 439/761 |
| 5,595,510 | * | 1/1997 | Obligar | 439/761 |
| 5,823,831 | * | 10/1998 | Bowater et al. | 439/773 |

* cited by examiner

*Primary Examiner*—Paula Bradley
*Assistant Examiner*—Truc Nguyen

(57) ABSTRACT

A battery terminal connector for a quick and easy way to connect and disconnect battery cables to a battery. The battery terminal connector includes a housing having an open top end, an open bottom end, an open side, a first side wall, and a second side wall and being adapted to retain a conventional battery coupler therein, and further includes a spring member having ends mounted to the first and second side walls at the open side, and also includes a lever pivotally mounted to the first and second side walls also at the open side and having a spring engaging member extending at an angle from an end of the lever, and further includes a cable fastener securely mounted on top of the housing.

8 Claims, 2 Drawing Sheets

BATTERY TERMINAL CONNECTOR

BACKGROUND OF THE INVENTION

1. Field of the Invention

The present invention relates to quick coupler for a battery terminal and more particularly pertains to a new battery terminal connector for a quick and easy way to connect and disconnect battery cables to a battery.

2. Description of the Prior Art

The use of quick coupler for a battery terminal is known in the prior art. More specifically, quick coupler for a battery terminal heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,764,961; U.S. Pat. No. 2,445,946; U.S. Pat. No. 1,953,821; U.S. Pat. No. 1,820,429; U.S. Pat. No. 4,021,094; and U.S. Pat. No. Des. 363,699.

While these devices fulfill their respective, particular objectives and requirements, the aforementioned patents do not disclose a new battery terminal connector. The inventive device includes a housing having an open top end, an open bottom end, an open side, a first side wall, and a second side wall and being adapted to retain a conventional battery coupler therein, and further includes a spring member having ends mounted to the first and second side walls at the open side, and also includes a lever pivotally mounted to the first and second side walls also at the open side and having a spring engaging member extending at an angle from an end of the lever, and further includes a cable fastener securely mounted on top of the housing.

In these respects, the battery terminal connector according to the present invention substantially departs from the conventional concepts and designs of the prior art, and in so doing provides an apparatus primarily developed for the purpose of a quick and easy way to connect and disconnect battery cables to a battery.

SUMMARY OF THE INVENTION

In view of the foregoing disadvantages inherent in the known types of quick coupler for a battery terminal now present in the prior art, the present invention provides a new battery terminal connector construction wherein the same can be utilized for a quick and easy way to connect and disconnect battery cables to a battery.

The general purpose of the present invention, which will be described subsequently in greater detail, is to provide a new battery terminal connector which has many of the advantages of the quick coupler for a battery terminal mentioned heretofore and many novel features that result in a new battery terminal connector which is not anticipated, rendered obvious, suggested, or even implied by any of the prior art quick coupler for a battery terminal, either alone or in any combination thereof.

To attain this, the present invention generally comprises a housing having an open top end, an open bottom end, an open side, a first side wall, and a second side wall and being adapted to retain a conventional battery coupler therein, and further includes a spring member having ends mounted to the first and second side walls at the open side, and also includes a lever pivotally mounted to the first and second side walls also at the open side and having a spring engaging member extending at an angle from an end of the lever, and further includes a cable fastener securely mounted on top of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new battery terminal connector which has many of the advantages of the quick coupler for a battery terminal mentioned heretofore and many novel features that result in a new battery terminal connector which is not anticipated, rendered obvious, suggested, or even implied by any of the prior art quick coupler for a battery terminal, either alone or in any combination thereof.

It is another object of the present invention to provide a new battery terminal connector which may be easily and efficiently manufactured and marketed.

It is a further object of the present invention to provide a new battery terminal connector which is of a durable and reliable construction.

An even further object of the present invention is to provide a new battery terminal connector which is susceptible of a low cost of manufacture with regard to both materials and labor, and which accordingly is then susceptible of low prices of sale to the consuming public, thereby making such battery terminal connector economically available to the buying public.

Still yet another object of the present invention is to provide a new battery terminal connector which provides in the apparatuses and methods of the prior art some of the advantages thereof, while simultaneously overcoming some of the disadvantages normally associated therewith.

Still another object of the present invention is to provide a new battery terminal connector for a quick and easy way to connect and disconnect battery cables to a battery.

Yet another object of the present invention is to provide a new battery terminal connector which includes a housing having an open top end, an open bottom end, an open side, a first side wall, and a second side wall and being adapted to retain a conventional battery coupler therein, and further includes a spring member having ends mounted to the first and second side walls at the open side, and also includes a lever pivotally mounted to the first and second side walls also at the open side and having a spring engaging member extending at an angle from an end of the lever, and further includes a cable fastener securely mounted on top of the housing.

Still yet another object of the present invention is to provide a new battery terminal connector that eliminates the user from having to use tools to connect and disconnect the battery cables to a battery.

Even still another object of the present invention is to provide a new battery terminal connector that is more secure and less likely to cause intermittent contact problems.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
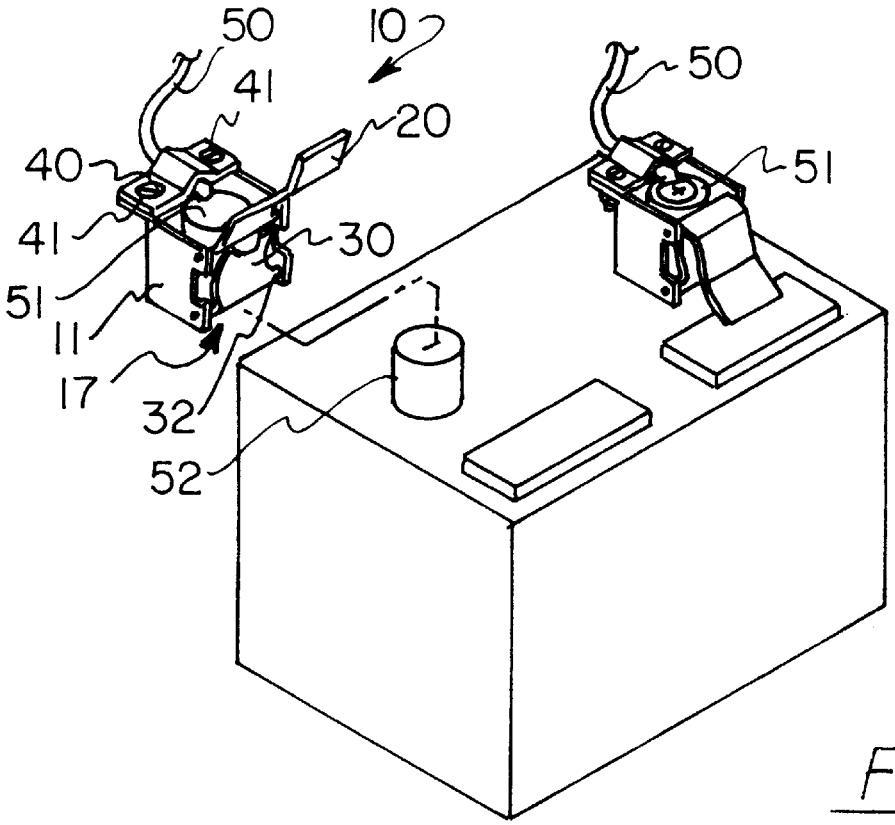
FIG. 1 is a perspective view of a new battery terminal connector according to the present invention.
Figure 2:
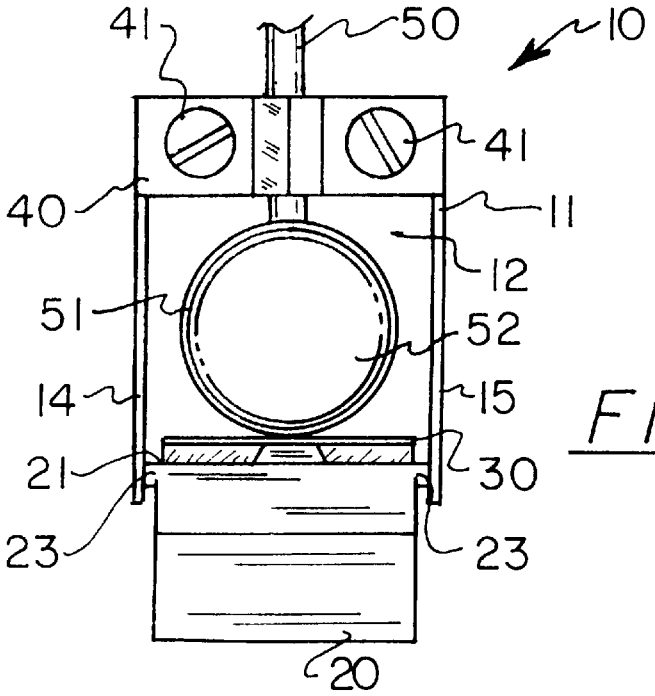
FIG. 2 is a top plan view of the present invention.
Figure 3:
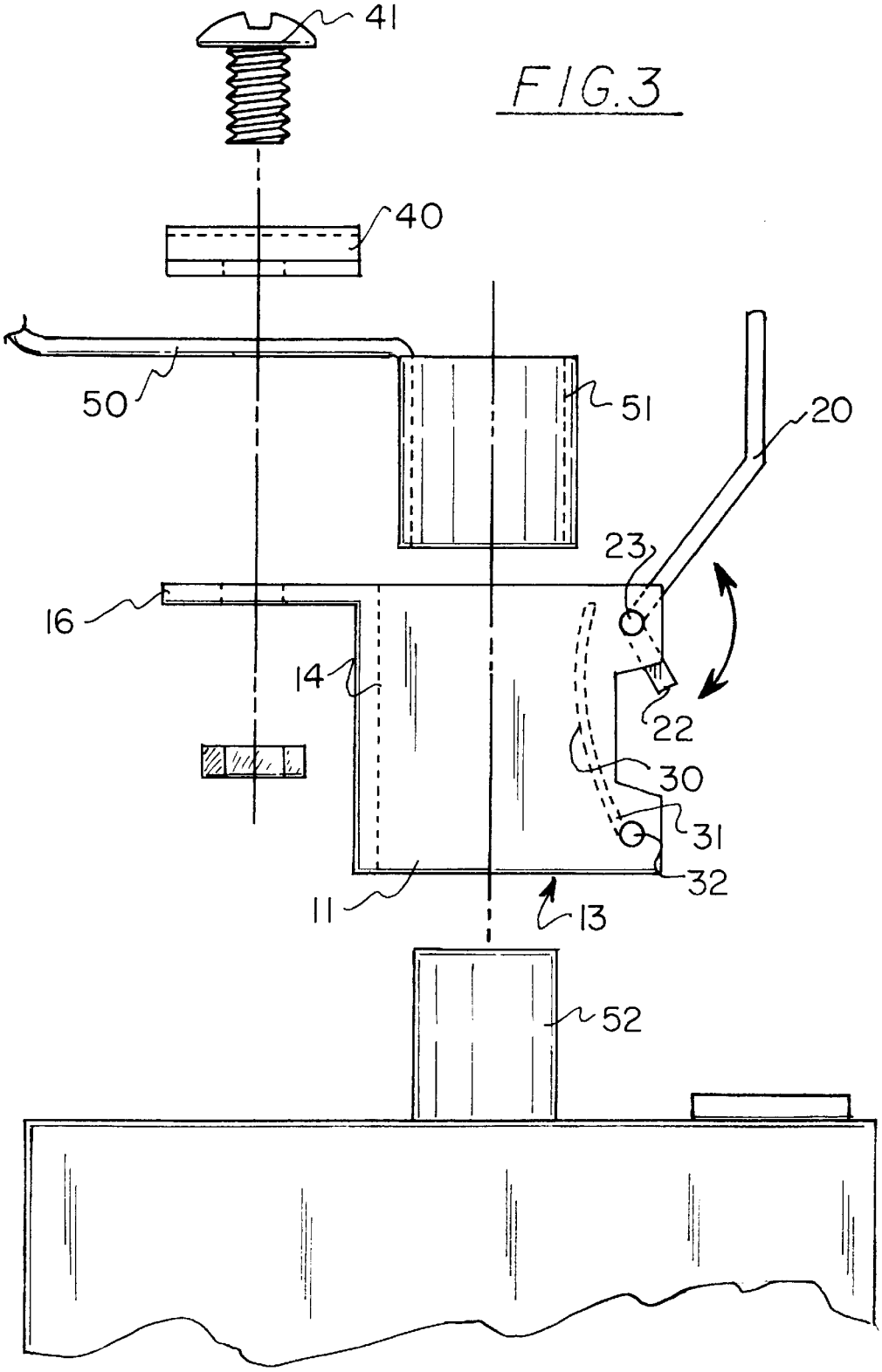
FIG. 3 is an exploded side view of the present invention.

With reference now to the drawings, and in particular to FIGS. 1 through 3 thereof, a new battery terminal connector embodying the principles and concepts of the present invention and generally designated by the reference numeral 10 will be described.

As best illustrated in FIGS. 1 through 3, the battery terminal connector 10 generally comprises a housing 11 having an open top 12 end, an open bottom end 13, a first side wall 14, a second side wall 15, and an open side 17. The housing 11 is adapted to receive a conventional battery terminal coupler 51 therein and further includes a cable fastener support member 16 integrally extending outwardly of the housing 11 at the top end 12 thereof and being generally planar. Each of the first and the second walls 14,15 has a slot extending in an edge thereof at the open side 17.

A spring member 30 is securely mounted to the housing 11 at the open side 17. The spring member 30 includes an end 31 having lateral extending projections 32 which extend through the first and second side walls 14,15 near the bottom end 13 of the housing 11. The spring member 30 is essentially a leaf spring;

A lever 20 having an end 21 pivotally mounted to the housing 11 and having a spring engaging member 22 extending from the end 21 thereof, includes lateral extending projections 23 integrally connected at the end 21 thereof, which extend through the first and second side walls 14,15 near the top end 12 and at the open side 17 of the housing 11. The spring engaging member 22 is essentially a planar member extending at an angle from the end 21 of the lever 20 for pivoting with the lever 20 to engage and urge the spring member 30 inwardly of the housing 11 for engaging a conventional battery coupler 51 with a battery terminal 52. The conventional battery coupler 51 is essentially a sleeve-like member and is adapted to fit about a battery terminal 52.

A cable fastener 40 is securely attached with bolts 41 to the housing 11 and is adapted to retain a battery cable 50 with the cable fastener 40 being removably fastened to the cable fastener support member 16 for fastening a cable 50 therebetween.

In use, the user would simply fasten the battery cable 50 between the cable fastener 40 and the cable fastener support member 16 with the conventional battery coupler 51 being disposed inside the housing 11. The user would then place the housing 11 and the conventional battery coupler 51 about the battery terminal 52 and would then lower the lever 20 such that the spring engaging member 22 would urge the spring member 30 securely against the conventional battery coupler 51 which would be securely urged against the battery terminal 52. To disconnect the conventional battery coupler 51, the user would simply raise the lever 20 to disengage the spring engaging member 22 from the spring member 30 which would disengage from the conventional battery coupler 51.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A battery terminal connector comprising:

a housing having an open top end, an open bottom end, a first side wall, a second side wall, and an open side, and being adapted to receive a conventional battery terminal coupler therein;

a spring member being securely mounted to said housing at said open side;

a lever having an end pivotally mounted to said housing and having a spring engaging member extending from said end thereof;

a cable fastener securely attached to said housing for being adapted to retain a battery cable; and wherein said spring member has an end having laterally extending projections which are securely mounted to said first and second side walls near said bottom end of said housing.

2. A battery terminal connector as described in claim 1, wherein said housing includes a cable fastener support member extending outwardly of said housing at said top end thereof.

3. A battery terminal connector as described in claim 1, wherein each of said first and said second walls has a slot extending in an edge thereof at said open side.

4. A battery terminal connector as described in claim 1, wherein said spring member comprises a leaf spring.

5. A battery terminal connector as described in claim 1, wherein said lever includes laterally extending projections at said end thereof, which are securely mounted to said first and second side walls near said top end and at said open side of said housing.

6. A battery terminal connector as described in claim 1, wherein said spring engaging member comprises a planar member extending at an angle from said end of said lever for pivoting with said lever to engage and urge said spring member inwardly of said housing for engaging a conventional battery coupler with a battery terminal.

7. A battery terminal connector as described in claim 1, wherein said cable fastener is removably fastened to said cable fastener support member for fastening a cable therebetween.

8. A battery terminal connector comprising:

a housing having an open top end, an open bottom end, a first side wall, a second side wall, and an open side, and being adapted to receive a conventional battery terminal coupler therein, said housing including a cable fastener support member integrally extending outwardly of said housing at said top end thereof, each of said first and said second walls having a slot extending in an edge thereof at said open side;

a spring member being securely mounted to said housing at said open side, said spring member including an end having lateral extending projections which are securely mounted to said first and second side walls near said bottom end of said housing, said spring member being essentially a leaf spring;

a lever having an end pivotally mounted to said housing and having a spring engaging member extending from said end thereof, said lever including lateral extending projections at said end thereof, which are securely mounted to said first and second side walls near said top end and at said open side of said housing, said spring engaging member being essentially a planar member extending at an angle from said end of said lever for pivoting with said lever to engage and urge said spring member inwardly of said housing for engaging a conventional battery coupler with a battery terminal; and a cable fastener securely attached to said housing for being adapted to retain a battery cable, said cable fastener being removably fastened to said cable fastener support member for fastening a cable therebetween.

* * * * *